US006475338B1

(12) United States Patent
Jiang et al.

(10) Patent No.: US 6,475,338 B1
(45) Date of Patent: Nov. 5, 2002

(54) METHOD OF MINIMIZING TRANSITION METAL IONS DURING CHEMICAL PULPING IN A DIGESTER BY ADDING CHELATING AGENT TO THE DIGESTER

(75) Inventors: Jian Er Jiang, Queensbury, NY (US); Kaj O. Henricson, Helsinki (FI)

(73) Assignee: Andritz Inc., Glens Falls, NY (US)

( * ) Notice: Subject to any disclaimer, the term of this patent is extended or adjusted under 35 U.S.C. 154(b) by 959 days.

(21) Appl. No.: 08/659,682

(22) Filed: Jun. 5, 1996

(51) Int. Cl.[7] ..... D21C 1/02; D21C 3/02; D21C 3/04

(52) U.S. Cl. ..... 162/19; 162/39; 162/68; 162/76; 162/82

(58) Field of Search ..... 162/65, 76, 78, 162/82, 19, 29, 30.1, 30.11, 31, 38, 39, 45

(56) References Cited

U.S. PATENT DOCUMENTS

| | | | | |
|---|---|---|---|---|
| 3,764,464 A | * | 10/1973 | Samuelson | 162/65 |
| 4,946,556 A | * | 8/1990 | Prough | 162/65 |
| 5,489,363 A | | 2/1996 | Marcoccia et al. | 162/43 |
| 6,413,367 B1 | | 7/2002 | Svedman | |

FOREIGN PATENT DOCUMENTS

| | | |
|---|---|---|
| SE | 9402229 | 12/1995 |
| WO | WO 95/02726 | 1/1995 |

OTHER PUBLICATIONS

Thermodynamic Characteristics of the Formation Reaction of the Magnesium Ethylenediaminetetra–acetato–complex in Aqueous Solution, Vasil'ev, V. P. and Belonogova, A.K., *Russ. J. Inorg. Chem. 20* (1975) 16.

Thermodynamic Characteristics of the Formation of the Calcium Ethylenediaminetetraacetate, Vasil'ev. V.P. and Belonogova, A.K., *Russ. J. Inorg. Chem 21* (1976) 31.

Thermodynamic Characteristics of the Ethelenediaminetetra–acetato–complex of Copper in Aqueous Solution, Vasil'ev, V.P. and Belonogova, A.K., *Russ J. Inorg Chem. 22* (1977) 1303.

Abstract of Master's Thesis, Development of a Liquid Chromatographic Method for the Determination of EDTA and DTPA in Pulp and Paper Mill process and Waste Waters, Mika Sillanpää, Helsinki University of Technology (1992).

Lucena et al; "Theoretical and Practical Studies on Chelate–Ca–pH System in Solution", Journal of Plant Nutrition, 11(6–11), 1051–1061 (1988), ©1988 by Marcel Dekker, Inc.

Nabhan et al, "Chelate Behaviour in Saline–Alkaline Soil Conditions", Plant and Soil 46, 603–618 (1977).

(List continued on next page.)

*Primary Examiner*—Steve Alvo
(74) *Attorney, Agent, or Firm*—Nixon & Vanderhye P.C.

(57) ABSTRACT

The production of chemical (e.g., kraft) cellulose pulp much more suited to totally chlorine free or elemental chlorine free bleaching is produced by reducing the bleaching chemical consumability of the produced pulp. The effective alkalinity of the pulp during at least the majority of the cooking stage is maintained at about 15 g/l or above (e.g., about 18–25 g/l), expressed as sodium hydroxide, so as to reduce the charged acid groups (including hexeneuronic acids) by at least 30% (e.g., at least about 50%) compared with pulp cooked at conventional alkalinity. Instead—or in addition to—the cellulosic material which produces the pulp may be heated to a temperature (at least about 100° C., preferably at least about 130° C.) to release significant quantities of the transition metals within it, and preferably while it has this elevated temperature and a dissolved organic solids concentration of about 120 g/l or less, a chelating agent (such as EDTA) is added to combine with a significant quantity of the released transition metals to produce complexes. At least a majority of the complexes are preferably removed (e.g., using an extraction screen in a digester) before the pulp is bleached.

20 Claims, 3 Drawing Sheets

OTHER PUBLICATIONS

"A comparison Between Acid Treatmetn and Chelation Prior to Hydrogen Peroxide Bleaching of Kraft Pulps", Bouchard et al, Journal of Pulp and Paper Science: vol. 21, No. 6, Jun. 1995, pp. J203–J208.

"Chelation Prior to Hydrogen Peroxide Bleaching of Kraft Pulps: An Overview", Bouchard et al, Journal of Pulp and Paper Science: vol. 21, No. 8, Aug. 1995, pp. J268–J272.

"Chelants Help to Meet Challenges of Alkaline Bleaching Conversion", Audette, Pulp & Paper, Nov. 1994, pp. 87 and 88.

"The behavior of certain inorganic ions in the wood/white liquor system", Hartler et al, Svensk Papperstidning nr 12 1973, pp. 454–457.

"Structure and composition of scale in continuous kraft digesters", Hartler et al, Svensk Papperstidning nr Jan. 2–31, 1972, pp. 65–70.

"The inorganic content of wood", Fossum et al, Svensk Papperstidning Nr 8, Apr. 30, 1972, pp. 305–309.

Arena et al, "Calcium– and Magnesium–EDTA Complexes . . . ", *Thermochimica Acta 61* (1983) 129.

Garvan, "Metal Chelates of Ethylenediaminetera–acetic Acid . . . ", Dwyer et al, Chelating Agents and Metal Chelates. Academic Press, New York and London, 1964.

Hovey et al, "Thermodynamics of the Complexes of Aqueous . . . "; *J. Phys. Chem. 89* (1985) 5541.

Martell et al, "Thermal Decomposition of EDTA, NTA and . . . ", *Can. J. Chem. 53* 1975) 3471.

Ganguli, "Sodium Hydrosulfite Bleaching of TMP . . . ", Pulp & Paper, Oct., 1980, pp. 108–110.

Bambrick, "The Effect of DTPA on reducing peroxide . . . ", TAPPI Journal, Jun., 1985, pp. 96–100.

* cited by examiner

METHOD OF MINIMIZING TRANSITION METAL IONS DURING CHEMICAL PULPING IN A DIGESTER BY ADDING CHELATING AGENT TO THE DIGESTER

BACKGROUND AND SUMMARY OF THE INVENTION

In response to market trends and government regulations, the Pulp and Paper Industry throughout the world is presently experiencing a transition from chlorine-based bleaching methods to non-chlorine or reduced-chlorine-based bleaching methods. The technical literature is presently replete with technical advancements extolling the performance of Totally Chlorine Free (TCF) bleaching processes or Elemental Chlorine Free (ECF) bleaching processes. The former processes employ no chlorine-containing chemicals at all, while the latter processes use chlorine dioxide as the only chlorine containing bleaching chemical along with other non-chlorine bleaching agents.

This trend toward eliminating or minimizing the presence of chlorine-containing compounds from the bleaching process also introduces the potential of re-using the non-chlorine containing liquid streams generated in the bleach plant of a pulp mill. In the trade and technical literature such "closed" mills are now described by the expressions Effluent Free Mill (EFM) or Closed-Cycle Mill. In the past, the collection and re-use of these liquids was uneconomical or technically impossible due to the potential corrosion damage or to interference with the process chemistry caused by the chlorine-containing chemicals in the systems and equipment used to recover and re-use these liquids. These chlorine-containing effluents were typically "sewered" and then, with or without treatment, discharged to the local "recipient", that is, to a lake, river or other body of water However, as disclosed in U.S. Pat. Nos. 5,374,333; 5,300,19, 5,302,246, 5,439,555 and copending application Ser. No. 08/113,642 filed on Aug. 31, 1993, now U.S. Pat. No. 5,549,788 and marketed under the trademark MIM by Ahlstrom Machinery of Glens Falls, N.Y., several processes and systems have been developed for reducing or eliminating chlorine-containing compounds in pulp mill liquid streams and effluent streams, or for recovering and re-using these valuable chemical-containing resources with no or minimal effect upon the surrounding environment.

However, current examination of the process chemistry, either theoretical or in mill trials, has revealed that this reduction or elimination of chlorine-based bleaching compounds is hindered by the presence of metal ions in the process streams. These metal ions, for example, ions of iron, copper, manganese, and magnesium, among others, interfere with process chemistry, for example pulping and bleaching, and can accumulate in the pulp mill and become manifest as precipitation deposits, that is "scale", on equipment.

These metals can be introduced to the pulp mill from several sources. For example, the wood supply may contain metal ions that naturally exist in the trees or other fiber source used. Metals may also be introduced as impurities in the chemicals introduced to the pulp mill, for example, in purchased acids or make-up chemicals. Metals ion may also originate from corrosion in the equipments itself.

In the past, when chlorine-based bleaching processes were the norm, the presence of metal ions in the pulp or process streams was not significant. For example, chlorine in an acidic environment solubilized the metal ions and they were subsequently removed from the system with the chlorine bleach effluent. As a result, the metal ions were simply purged from the system when the chlorine-containing bleach effluent was sewered. However, present non-chlorine-based bleaching chemicals, such as ozone and peroxide, do not react with the metal ions in a beneficial fashion but tend to be consumed by metal ions and thus these ions negatively effect the bleaching reaction. It is now believed that in addition to consuming, for example, peroxide, metal ions may catalyze reactions which produce by-products that undesirably also consume bleaching chemical. Thus the presence of dissolved metal ions in the bleaching stages reduces the efficiency, and hence increases the cost, of the bleaching process. To address this problem, typical conventional TCF or ECF bleaching sequences incorporate some form of metal-removing treatment, for example, a treatment with chelating agents (also known as sequestering agents or metal-complex forming agents) or an acid wash, or a "hot acid" treatment as disclosed in pending, U.S. application Ser. No. 08/542,646 filed on Oct. 13, 1995, and now abandoned.

In this specification and claims the term "chelating agent" or "chelant" is used to refer to any chemical compound having strong affinity for transition metal ions, including Mn, Fe and Cu ions, and tending to combine with the metal ions. This process is also referred to the "sequestering" of metal ions; thus these compounds are also referred to as "sequestering agents". Furthermore, the chelant-metal ion compounds that are formed are often referred to as "complexes"; thus chelating agents are also referred to as "metal complexing agents" or "complex forming agents". The term "chelating agent" as used herein encompasses all these terms, and the released transition metals combined with chelating agent are referred to as "complexes".

The presence of dissolved transition metal ions also hampers the process of mill "closure", that is, the recovering and re-using effluents. As discussed above, the presence of metals in a bleach plant is typically minimized by some form of metal-removal treatment. However, if the effluents resulting from such treatment, which contain dissolved metal ions, are to be reused the metal ions must be removed. U.S. Pat. No. 5,401,362 and co-pending applications Ser. No. 08/113,645 filed on Aug. 31, 1993 and Ser. No. 08/195,139 filed on Feb. 14, 1994 illustrate several methods of treating metal-containing effluents to remove the metals prior to re-use.

In addition to these treatments of the effluent streams, the presence of transition metal ions within the pulp mill can also be minimized by purifying the chemicals introduced to the mill to eliminate their introduction of metals. Also, non-corrosive metallurgy can also be used to minimize or eliminate the potential for introducing dissolved metals from corrosion. However, regardless of these and other remedies for reducing the introduction of metal ions to the pulp mill, metal ions can still enter the mill with the original wood supply, or other source of cellulose.

Published PCT application WO 95/02726 discloses one method that attempts to reduce the metal ion concentration prior to digestion in a digester. The disclosed process includes a treatment of cellulose material, for example, softwood chips, with a liquid containing a chelating agent prior to formal digestion of the material. Though this treatment reduces the concentration of various dissolved metals, it does not treat the material with chelating agents in the most advantageous stage. Since metals-containing substances are released from the cellulose in essentially all phases of the cook, treating and removing the metals prior to the cook as disclosed in the PCT application is not the most advantageous treatment. There are certain stages of the cooking process where more metal ions are released from the cellulose and can be more effectively removed. Furthermore, some metals are inherently removed during the kraft cooking process. Chelating chemicals need not be wasted removing metals that would be removed from the process anyway. In addition, the PCT publication does not recognize other significant features of the present invention.

Though the chemical mechanism is not yet completely understood, it is believed that the naturally-occurring metal ions that are present in cellulose material , for example, wood chips, are strongly bound to the wood material. As shown in the article "The Behavior of Certain Inorganic in the Wood/White Liquor System" by Hartler, et al. (Svensk Papperstidning, No. 12, 1973), these metal ions are typically not released from the cellulose until well into the pulping process, for example, not until the pulping temperature reaches at least 50° C., preferably at least about 100° C., or even about 150° C. or more, Only at these temperatures or higher will the metal ions present in the cellulose be released into the slurry liquid; only at these temperatures will these ions be available for sequestering by a chelating agent or re-attachment to the cellulose material.

In addition to chelating agents, other naturally occurring compounds, such as lignin and carboxylic groups in the carbohydrates, will also compete for the released metal ions. Since it is undesirable for the released metal ions to become attached or re-attached to these organic compounds and be retained in the pulp stream, the effectiveness of the metal removal treatment is dependent upon the addition point of the chelant. If the chelant is present at a point where the lignin concentration or carboxylic group concentration is high, the metal removal may not be as effective as if the chelant were present when the concentration of these compounds is lower. Therefore, a preferred location for having chelating agents present in the cooking process is at a point where the temperature is above about 100° C., typically above about 130° C., and preferably above about 150° C., and where the dissolved organic material [including lignin, hemi-cellulose, and other organics as disclosed in U.S. Pat. No. 5,489,363] concentration is low, typically, less than about 120 g/l, preferably, less than about 100 g/l, and even less than 90 g/l.

Another consideration when attempting to minimize the presence of dissolved metal ions during chemical pulping is the presence of hexeneuronic acids. As recently discovered, compounds generally referred to as hexeneuronic acids are formed during alkaline pulping. These compounds are not naturally-occurring in the cellulose, for example, wood chips, but are formed during the alkaline pulping process. For example, naturally-occurring 4-0-methylgluconic acid (MeGlcA) transforms into hexeneuronic acid (HexA) during the kraft cooking process. These electrically charged hexeneuronic acids are one of the primary sources of charged sites on the cellulose fiber. It is believed that these charged sites provide the means by which metal ions typically are attached to cellulose fibers.

The effect of the presence of these hexeneuronic acids is illustrated by experience in bleaching pulps produced from non-alkaline processes. It has long been known that it is relatively simpler to peroxide bleach pulps produced from the acid sulfite process or by mechanical processes, both non-alkaline processes, than it is to peroxide bleach alkaline kraft pulps. However, the reason for this difference has not been Understood. It has now been realized, surprisingly, that the above difference is related to the presence of the above-mentioned hexeneuronic acids. It has been discovered that hexeneuronic acids do not exist in both sulfite and mechanical pulps. As noted above, it is known that metal ions consume peroxide or at least degrade the peroxide bleaching process. Since the hexeneuronic acid provide sites for attachment of metal ions, minimizing these acids will minimize the sites to which metal ions can attach to cellulose. Thus, minimizing the concentration of charged acid groups, for example, hexeneuronic acids, minimizes the transport of metal ions to the metal ion-sensitive bleaching stages and therefore improves the bleaching of pulp.

In its broadest concept the present invention comprises a method of treating comminuted cellulosic fibrous material during the production of chemical (e.g., kraft) pulp so that the presence of bleaching-chemical-consumability of the resulting pulp is minimized (e.g., the metal ions are minimized in the resulting pulp). One method of effecting this is to have chelating agents present in the cooking process when the metal ions are released from the cellulose.

Thus, according to one embodiment of the present invention there is provided a method of producing chemical cellulose pulp from comminuted cellulosic fibrous material containing metal ions, using a cooking vessel, comprising the steps of: (a) Steaming the comminuted fibrous material to remove air and begin heating thereof [this stage necessary only in continuous treatment, not batch]. (b) Pressurizing and slurrying the material in cooking liquor and introducing the slurry of material an cooking liquor into a cooking vessel. (c) Heating the material to at least a first temperature such that at least a significant amount of the transition metal ions are released to the slurry liquor. (d) Treating the slurry with a chelating agent which combines with at least the released transition metal ions in the slurry to produce complexes. (e) Cooking the material in the cooking vessel at a second temperature (which may be higher than said first temperature, but may be about the same or if the first temperature is high enough even lower) to produce chemical pulp; and (f) discharging the chemical pulp from the cooking vessel. The invention preferably includes the additional step (g), between steps (d) and (e) of removing at least some lo of (preferably at least a majority of) the chelated metal ions (complexes) from the slurry, and during step (c) at least 10% of the transition metal ions are released.

The treatment with chelating agent may be for a time period between about 5 minutes to 6 hours, but it is typically performed for between about 10 to 180 minutes, or preferably between about 15 to 120 minutes.

Typical chelating agents include EDTA and DTPA, and their equivalents, but certain organic acids may also be used, for example, oxalic acid, tartaric acids, and furoic acid. These organic acids are preferably obtained from existing pulp mill processes, for example, a bleaching process. The chelating agent is preferably one that is temperature resistant, that is, it is effective at typical cooking temperatures, about 150° C., and can withstand high pH, that is, a pH greater than 10, preferably greater than about 12. The dosage of chelating agent ranges from 0.1 to 10 kg. per ton of pulp, and the dose is preferably between about 1–5 kg per ton of pulp. This dosage is effective to combine with at least about 10% of the metals released from the material, typically at least a majority of the released metals, and preferably substantially all (i.e. greater than 90%) of the released metals, to form complexes.

The invention is preferably performed wherein said first temperature of step c) is at least about 100° C., typically at least about 130° C., and preferably at least about 150° C. The second temperature of step e) is typically between about 140 and 180° C., preferably between about 150 and 170° C., and at least about 160° C. if the first temperature is about 150° C. The cooking vessel of step b) is preferably a pretreatment vessel or impregnation vessel or digester. The treatment may be performed continuously or in a batch process.

Since some of the material dissolved and released into solution during the cooking process are the undesirable transition metal ions, removing spent cooking liquor containing dissolved transition metals from the cooking process minimizes the concentration of dissolved transition metals in the resulting pulp. The process of minimizing the concentration of dissolved material in the pulping process in general is disclosed in U.S. Pat. No. 5,489,363 (the disclosure of which is hereby incorporated by reference herein) and is marketed under the trademark LO-SOLIDS by Ahlstrom Machinery of Glens Falls, N.Y. However, another embodiment of this invention is the combination of the process of U.S. Pat. No. 5,489,363 with the addition of chelating agents. In combining these two processes, the chelating agent is introduced to the pulp when the concentration of dissolved transition metal ions is already minimized and the chelating agent neither competes with the chelating effect of the dissolved organic material nor is wasted on metal ions that are already attached or will soon be attached to dissolved organic material and removed. This embodiment of the invention thus comprises a method for producing pulp by cooking comminuted cellulosic fibrous material by: a) extracting liquor containing a level of dissolved organic material; b) replacing some or all of the extracted liquor with liquid containing a substantially lower level of effective dissolved organic material than the extracted liquor; and wherein the replacement liquor of step b) contains at least one compound that combines with transition metal ions and can subsequently be readily removed. The compound is typically a chelating agent as described above. The chelating agent may be fresh EDTA or DTPA, or may be bleach plant effluent. Some bleach plant effluents contains acid compounds, for example, furoic or maleic acids, that act as chelating agents.

In another specific application of this invention, the metal-complex former or chelating agent is preferably added downstream of a liquor extraction or after or during the process of extracting and diluting the cooking liquor as in the process of U.S. Pat. No. 5,489,363. This chelate treatment may be practiced in a co-current or counter-current cooking mode, in a single or multi-vessel digester system, in a hydraulic or dual phase digester, or in a batch or continuous fashion.

In a continuous digester, the chelating agent is preferably added downstream of a counter-current cooking zone or upstream of a co-current cooking zone. For example, the chelating agent is preferably added to the lower cooking circulation or the wash circulation of a single-vessel Lo-Solids® digester. In a batch digester, the chelating agent is preferably added when the cellulose material is heated by displacement with spent cooking liquor to between about 140 and 165° C. or shortly thereafter.

Chelating agents may also be added to the first washing stage following the cooking stage, either within or external to the digester, and the chelating agent passed counter-currently to the latter stages of the cooking process where the dissolved solids concentration is relatively low. For example, chelating agents can be added to the "cold blow" circulation of a Kamyr® continuous digester, sold by Ahlstrom Machinery, or to the weak liquor used for displacement in the final stages of a batch cooking process.

In another preferred embodiment, the transition metal removing agent, for example chelating agent, may be displaced into the cellulose material after pretreatment and before the formal cook. Though, as described above, co- or counter-current displacement of the chelating agent can be performed in a continuous or batch digester, the chelating agent may also be radially displaced into the pulp. For example, after the cellulose material slurry is heated above a temperature at which metal ions are released into solution, for example, to about or above 140° C., the chelating agent may be radially displaced through the slurry by means of cooking liquor added in a cooking circulation. For instance, after pretreatment of the cellulose material, for example with spent cooking liquor, the time required for impregnating the material with cooking liquor, for example kraft white liquor, is relatively short, typically only about 5 to 10 minutes. Subsequently, the radial displacement treatment with a chelating agent and impregnation may be performed via a single screen assembly in a continuous digester, but two screen assemblies are preferred. This horizontal radial addition of chelating agent may be performed at the bottom of a pretreatment vessel or at the top of a digester.

Another method for reducing the metal ion content of the cooked pulp is to prevent the formation of electrically charged sites on the pulp, for example, charged sites due to charged acid groups, specifically, hexeneuronic acids, to which metal ions are drawn. This can be achieved by increasing the alkalinity of the cooking liquor. This increased alkalinity neutralizes the acid groups such that charged metal ions do not become attached to the pulp. The alkalinity of cooking liquor is typically expressed as grams per liter of effective alkali (EA), expressed as NaOH [that is, g/l EA as NaOH]. In conventional alkaline cooking, this EA is consumed during the cooking process such that at the end of the cook the EA is about 10 g/l or less. By increasing the alkalinity during or at the end of the cook and effectively raising this EA at the end of the cook, for example to at least about 15 g/l (e.g., 15–40 g/l), preferably between about 18–25 g/l expressed as sodium hydroxide, the charged acid groups are preferably neutralized and their charged sites reduced. For example, charged hexeneuronic acids can be reduced by at least about 30%, typically at least by about 50%, or by as much as about 80% by raising the alkalinity at the end of the cook. As a result, transition metals ions do not attach to the cellulose and are not retained in the pulp.

For example, according to another exemplary method of producing chemical cellulose pulp according to the invention, the following steps are practiced: (a) Cooking comminuted cellulosic fibrous material at a temperature of between about 140–180° C., and at an effective alkalinity such that the charged acid group concentration during cooking is at least about 30% less than the concentration of charged acid groups present after cooking of the same material at an effective alkalinity of about 10 g/l or less, expressed as NaOH, to produce a chemical pulp; and (b) bleaching the chemical pulp in at least one non-chlorine bleach stage (any one or more conventional non-chlorine bleaching stages or sequences can be used, including those with oxygen (including oxygen delignification), ozone, peroxide, hydrosulfite, etc.). Preferably during at least the majority thereof step (a) is practiced at an effective alkalinity of between about 15–40 g/l (most desirably 18–25 g/l) expressed as NaOH. The method may also comprise the further steps of: (c) heating the material prior to step (a) to a temperature of at least about 100° C. (e.g., at least about 130°, preferably at least about 150° C.) so as to release at least 10% (and preferably at least a majority of) the transition metal ions therein; (d) adding chelating agent in the amount of 0.1–about 10 (preferably about 1–5) kg per ton of pulp so that the chelating agent is present during the practice of step (a), and so that it combines with at least about 10% (and preferably at least the majority) of the released transition metals to form complexes; and (e) removing at least 10% (and preferably at least the majority) of the complexes prior to step (b). During treatment with chelating agent the slurry preferably has a dissolved organic material concentration of less than about 120 g/l (preferably less than 100 g/l, and even less than about 90 g/l).

According to another aspect of the present invention a method of producing chemical cellulose pulp is provided comprising the following steps: (a) Treating comminuted cellulosic fibrous material having metals therein, slurried with cooking liquor, to a temperature of at least about 100° C. to a significant amount of the transition metals therefrom, and so that the slurry has a dissolved organic material concentration of less than about 120 g/l. (b) Treating the slurry from step (a) with a chelating agent in an amount effective to combine with at least a significant amount of the released transition metals to produce complexes. (c) Cooking the slurry from step (b) to produce a low non-chlorine bleaching chemical consuming content chemical pulp; and (d) bleaching the chemical pulp from step (c) in at least one non-chlorine bleaching stage (as described above, i.e. any non-chlorine bleaching stage or sequences).

In the method described above, typically step (a) is practiced at a temperature of at least about 130° C., and to release at least about 10%, preferably at least about 50%, of the transition metals from the material, and so that the dissolved organic material concentration is less than about 100 g/l; and step (b) is practiced by treating the slurry with a chelating agent in an amount effective to combine with at least about 10%, and preferably at least about 50%, of the released transition metals (e.g., between about 1–5 kg per ton of pulp produced). There preferably is also the further step (e), between steps (b) and (d), of removing a majority of the complexes, such as by using extraction screens in a continuous digester. Step (b) may be practiced by adding bleach plant effluent. Step (c) may be practiced at a temperature greater than the temperature of step (b), and between about 140–180° C.; and step (e) may be practiced between steps (b) and (c). Alternatively, step (b) may be practiced at a temperature of at least about 150° C. and step (c) at a temperature of at least about 160° C. Step (b) preferably is practiced at a pH of at least 10, and preferably at least about 12. Also, at least the majority of step (c) is practiced at an effective alkalinity of between about 15–40 (preferably about 18–25) g/l expressed as NaOH, so as to reduce the concentration of charged acid groups, including hexeneuronic acids, in the pulp produced in step (c), by at least 30% compared to if step (c) is practiced at an effective alkalinity of less than about 10 g/l expressed as NaOH.

The invention also relates to a new pulp, having lower non-chlorine bleaching chemical consumability than conventional kraft pulp. For example according to another aspect of the invention, pre-bleached low bleaching chemical consumption kraft pulp is produced by the steps of: (a) treating comminuted cellulosic fibrous material having transition metals therein, slurried with cooking liquor, to a temperature of at least about 100° C. to release a significant amount of the transition metals therefrom, and so that it has a dissolved organic material concentration of less than about 120 g/l; (b) treating the slurry from step (a) with a chelating agent in an amount between 0.1–10 kg/ton of pulp, and effective to combine with a significant amount of the released transition metals to produce complexes; (c) kraft cooking the slurried material from step (b); (d) preparing the pulp from step (c) for bleaching in at least one non-chlorine bleaching stage; and (e) removing a significant amount (e.g. a majority) of the complexes between steps (b) and (d) so as to produce kraft pulp having a bleaching chemical consuming metals content at least 30% lower than conventional kraft pulp produced without the practice of steps (b) and (e). This pulp may also be used to produce a paper product containing minimal amounts of transition metal-containing compounds.

It is the primary object of the present invention to produce chemical pulp which consumes less non-chlorine bleaching chemicals than conventional chemical pulps produced from the same raw material (e.g., softwood chips). This and other objects of the invention will become clear from an inspection of the detailed description of the invention, and from the appended claims.

DETAILED DESCRIPTION OF THE DRAWINGS

Figure 1:
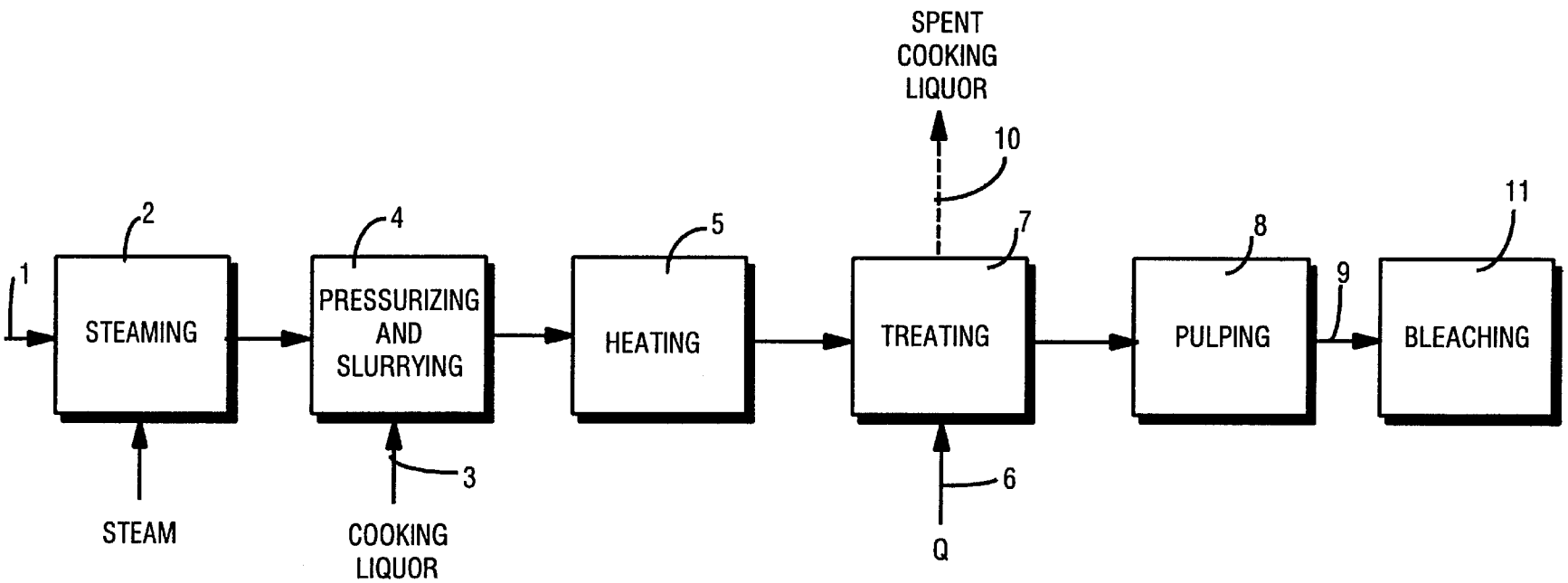
FIG. 1 is a schematic illustration of an exemplary flow chart for an exemplary method according to the present invention.

FIG. 1 schematically illustrates one embodiment of a method according to the present invention. Cellulosic fibrous material, such as softwood chips, 1 is steamed at 2 to remove excess air and to being heating the material. The steaming at 2 may be performed using any conventional techniques, preferably with a DIAMONDBACKTM™ steaming vessel, as described in copending U.S. application Ser. No. 08/205,552 filed Feb. 14, 1994, and such as sold by Ahlstrom Machinery. After steaming, cooking liquor (e.g., white liquor or black liquor) 3 is added to the material to form a slurry, and the slurry is pressurized, as schematically illustrated at 4. Slurrying and pressurizing may be performed in a conventional high pressure feeder, or by a slurry pump and feeder as described in U.S. Pat. No. 5,476,572, both sold by Ahlstrom Machinery.

The cellulose material slurry is then heated at 5 to a temperature at which transition metal ions dissociated from the material. This temperature is at least about 100° C., typically at least about 130° C., and preferably at least about 150° C. With the transition metal ions released from the material (typically in solution) a chelating agent (EDTA, DTPA, or any other conventional chelating agent, or bleach plant effluent) Q from line 6 is added to the heated slurry to treat the slurry in treatment stage 7, and combine with the transition metal ions to form complexes. The slurry is then further heated to pulping temperature (e.g., between about 140–180° C., preferably between about 160–170° C.) and the pulping process continues as schematically indicated at 8 (e.g., in a batch or continuous digester for at least the later stages of cooking, although possibly also in a pretreatment or impregnation vessel), producing a transition metal depleted, low bleaching chemical consumability, pulp 9.

Preferably prior to or during the treatment stage 7 at least some of the spent cooking liquor, perhaps containing dissolved organics therein, but certainly containing dissolved complexes, is removed from the process in stream 10. The pulp in line 9 is passed to either TCF or ECF bleaching, as illustrated at 11 in FIG. 1, normally after washing, storage, or other treatments.

Figure 3:
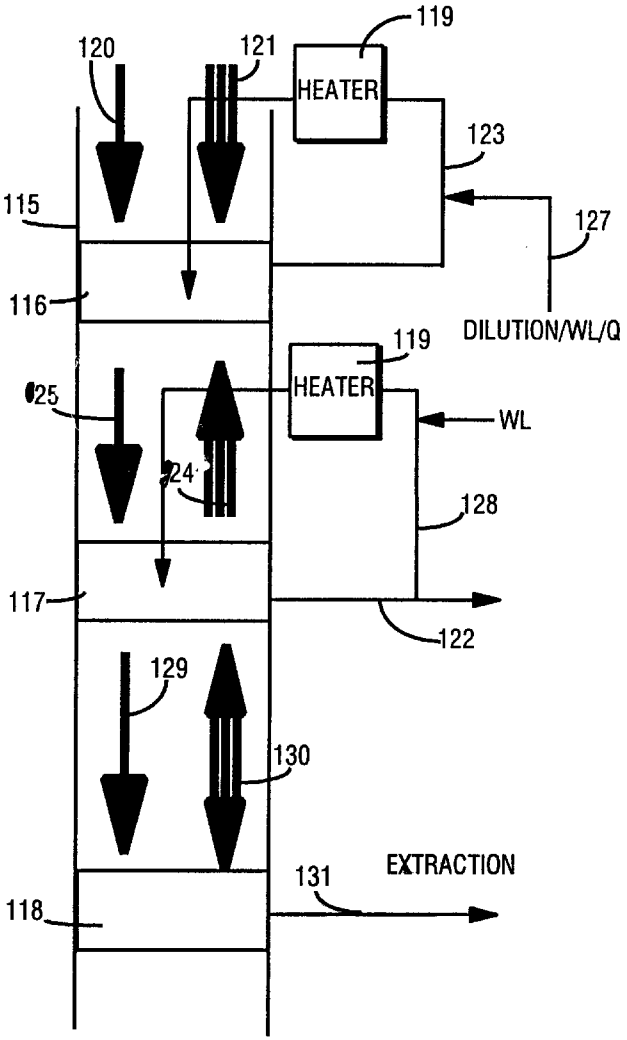
FIGS. 2–4 are diagrammatic illustrations of different exemplary systems for practicing the major method steps of exemplary methods according to the invention.
Figure 2:
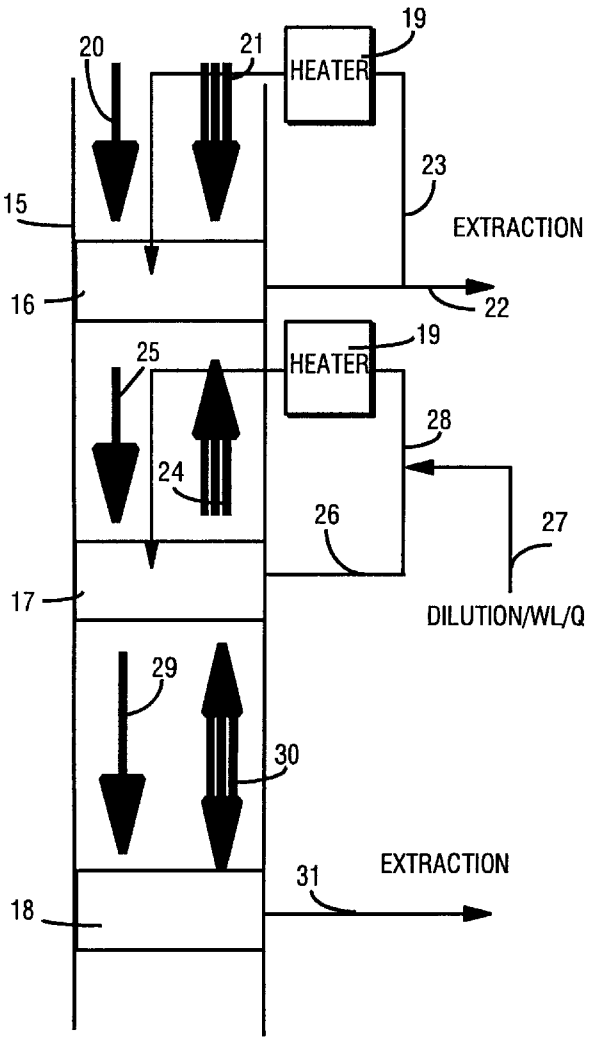

FIGS. 2 and 3 illustrate two typical methods for combining the benefits of LO-SOLIDS® cooking, in which the concentration of dissolved organic material is kept low (100 g/l or less) during substantially the entire cook, with transition metal removal. FIG. 2 schematically depicts a section of a continuous digester 15 which may be of any conventional type (single or multi-vessel, hydraulic or dual phase, etc.). After feeding or pretreatment the cellulose material, e.g., softwood chips, 20 and the cooking liquor (e.g., white liquor, WL) 21 are introduced into the top of the digester 15. In the counter-current treatment shown in FIG. 2 the chips 20 and liquor 21 first encounter screen system 16, which removes some of the spent cooking liquor in line 22, acting as an extraction screen. Some of the removed liquor is recirculated in line 23 and reintroduced (typically after heating with conventional heater 19) into the digester 15 adjacent the screen system 16.

The pulp slurry at the screen system 16 is typically at a temperature of at least about 130° C. The removal or extraction 22 causes a counter-current flow of liquor 24 below screen 16. The cellulose material 25 proceeds to the next screen system 17 where liquid is removed and recirculated as indicated at 26, 28. As in U.S. Pat. No. 5,489,363 the liquor in line 26 is preferably combined with one or more of dilution liquor and white liquor as indicated at 27 prior to reintroduction into digester 15 adjacent screen system 17. Pursuant to this invention, the line 27 is supplemented with a chelating agent Q (e.g., between about 0.1–10 kg, preferably between about 1–5 kg, per ton of pulp). The chelating agent Q may be EDTA, DTPA, bleach plant effluent containing furoic or maleic acids, or the like, preferably in an amount effective to combine with at least 10% of, and preferably at least a majority of (if not substantially all) of the released transition metal ions in the slurry to form complexes. Due to the extraction at 22, and the countercurrent flow of liquid 24, the complexes are removed with liquid in extraction 22, and if an extraction is also provided for loop 26, 28 further complexes will be removed there. Thus during treatment between screens 16–17, during which the material is at a temperature of at least 130° C. and preferably at least about 150° C., metals (e.g. transition metals such as Mn, Fe and Cu, but not necessarily Mg, Na or Ca, which are desirable) that would consume non-chlorine bleaching chemicals are removed.

Below screen 17 the material continues to cook, in a co-current or counter-current fashion depending up the direction of liquor flow 30. The method may also include a subsequent extraction 31 at screen 18, and further treatment, for example counter-current cooking, and/or washing, below screen 18 and prior to discharge of the low metal content pulp (as at 9 in FIG. 1).

FIG. 3 illustrates a system similar to that of FIG. 2, including a digester 115 for co-current treatment with chelant. In FIG. 3 components or flows similar to those in FIG. 2 are shown by the same two digit reference numeral only preceded by a "1"; the digester 115 and screens 116, 117 of the FIG. 3 embodiment are substantially the same as those in FIG. 2, but the locations of the extractions and dilutions have changed in FIG. 3 compared to FIG. 2.

In FIG. 3 the roles of the screen assemblies 116, 117 are reversed from those of the screens 16, 17 in FIG. 2. The dilution liquid, cooking liquor, and chelant Q 127 are introduced to the first circulation 123 such that they pass co-currently as indicated at 124 to the cellulose material flow 125. The screen 117 acts as an extraction screen for removal of spent liquor 122. Cooking liquor (WL) may also be added to circulation 128 so that further cooking occurs below screen 117.

Figure 4:
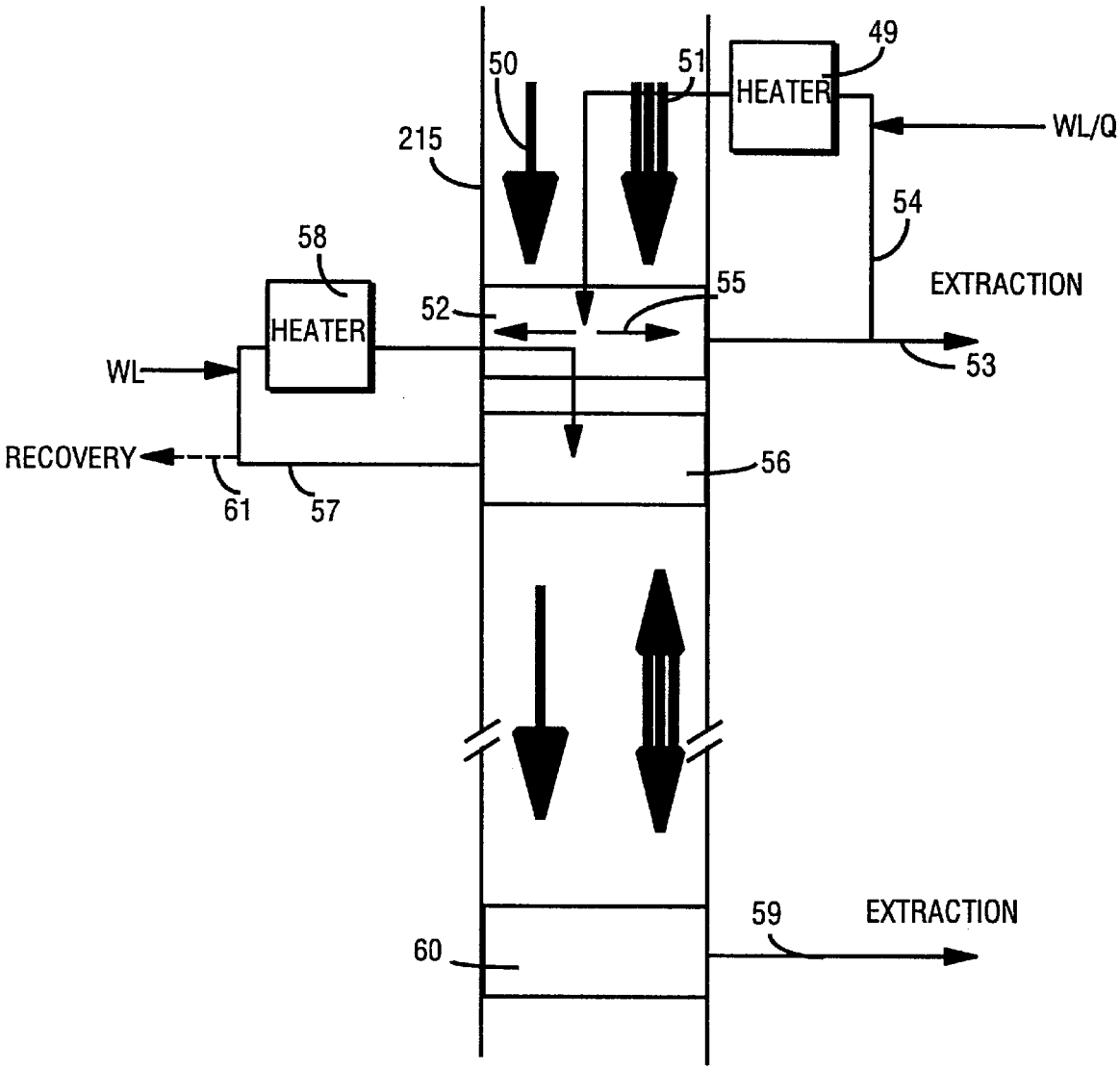

FIG. 4 illustrates a system for performing radial displacement impregnation of pulp with cooking liquor and chelant. In continuous digester 215 (similar to 15, 115) wood chips 50 and liquor 51 are introduced into a treatment zone. The chips preferably have been steamed pretreated, for example with spent cooking liquor, so that the required liquor impregnation time is less than about twenty minutes, typically less than about ten minutes, and preferably less than about five minutes. Therefore, impregnation may be performed in a radial fashion at screen assembly 52. Some of the liquor removed at 52 may be extracted, as indicated at 53, or recirculated as indicated at 54. In a preferred embodiment, cooking liquid and chelating agent [WL/Q] are heated in conventional heater 49 and introduced via circulation 54 to the center of the digester 215, and pass as indicated at 55 radially to screen 52.

After rapid radial impregnation 155 the chips pass to screen 56 where liquor is extracted and recirculated in recirculation 57 to the vicinity of screen 56. Cooking liquor may be added to the circulation 57, as well as heat (via conventional optional heater 58). Some of the liquor removed via screen 56 may be removed and sent to recovery, as illustrated at 61.

Below screen 56 the cellulose material may be further treated, either co-currently or counter-currently. The treatment may include a spent cooking liquor extraction 59, using screen 60, prior to discharge of low metal content pulp (e.g., 9 in FIG. 1) from the digester 215.

In any one of the embodiments of FIGS. 2–4 the dissolved solids content of the pulp while being treated with chelating agent—which low dissolved solids content is obtained by the extractions such as 22, 122 and 61—is less than 120 g/l, preferably less than 100 g/l (e.g., about 90 g/l or less). Also, the effective alkalinity (EA) of the pulp during at least a majority of the cook, and preferably substantially all of the cook (but at least the later stages thereof) is maintained above about 15 g/l expressed as NaOH. For example the EA may be between about 15–40 g/l, e.g., between about 18–25 g/l. This level of alkalinity—compared to conventional EAs in kraft cooking of less than about 10 g/l—results in the charged acid group (including hexeneuronic acids) being reduced by at least about 30% (preferably by at least about 50%, e.g., by about 80%).

It will thus be seen that according to the present invention a method of producing chemical pulp, and a chemical pulp produced according to the method, are provided wherein there is less consumption of non-chlorine bleaching chemicals by the pulp. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods and pulps.

What is claimed is:

1. A method of producing chemical cellulose pulp from comminuted cellulosic fibrous material containing metal ions, using a continuous digester, comprising the steps of:

(a) pressurizing and slurrying the comminuted cellulosic fibrous material containing metal ions, heating the material, and impregnating the material with cooking liquor, to release transition metal ions from the material;

(b) in the continuous digester, and after step (a), at a temperature of between about 140–180° C., adding chelating agent and cooking liquor to the slurry so as to effect cooking of the material to produce chemical pulp, and so that the chelating agent combines with released transition metal ions in the slurry to produce metal complexes;

(c) during cooking of the material, extracting liquid containing the metal complexes from the digester; and (d) after steps (b) and (c), washing the chemical pulp, and withdrawing the chemical pulp from the continuous digester.

2. A method as recited in claim 1 wherein the digester has a co-current cooking,zone, and wherein step (b) is practiced just upstream of the co-current cooking zone so that the chelating agent, cooking liquor, and material flow co-currently in the co-current cooking zone.

3. A method as recited in claim 2 wherein step (b) is practiced to add chelating agent in the amount of between about 1–10 kg per ton of chemical pulp produced.

4. A method as recited in claim 2 wherein step (a) is practiced so as to heat the material to a temperature of at least 130° C., and sufficient to release at least the majority of the transition metal ions from the material, and wherein step (b) is practiced to introduce a sufficient amount of chelating agent to react with at least the majority of the transition metal ions from the material, and wherein step (c) is practiced to remove metal complexes containing at least the majority of the transition metal ions from the material.

5. A method as recited in claim 2 wherein the continuous digester has first and second cooking screens, the first screen vertically above the second; and wherein step (b) is practiced to introduce chelating agent adjacent the first screen, and wherein step (c) is practiced to remove metal complexes using the second screen.

6. A method as recited in claim 5 wherein the continuous digester has a third screen, below the second screen, and either a co-current or a counter-current cooking zone between the second and third screens; and wherein step (c) is practiced to also remove liquid with metal complexes from the third screen.

7. Method as recited in claim 6 wherein during all cooking zones in the continuous digester the effective alkalinity of the slurry is between 18–40 g/l expressed as NaOH.

8. A method as recited in claim 2 wherein step (b) is practiced while the pH of the slurry is greater than 10.

9. A method as recited in claim 2 wherein step (a) is practiced to heat the slurry to a temperature of at least 150° C., and step (b) at a temperature of at least 160° C.

10. A method as recited in claim 1 wherein the digester has a counter-current cooking zone, and wherein step (b) is practiced just downstream of the counter-current cooking zone so that the chelating agent and cooking liquor flow counter-currently to the material in the counter-current cooking zone.

11. A method as recited in claim 10 wherein step (b) is practiced to add chelating agent in the amount of between about 1–10 kg per ton of chemical pulp produced.

12. A method as recited in claim 10 wherein step (a) is practiced so as to heat the material to a temperature of at least 130° C., and sufficient to release at least the majority of the transition metal ions from the material, and wherein step (b) is practiced to introduce a sufficient amount of chelating agent to react with at least the majority of the transition metal ions from the material, and wherein step (c) is practiced to remove metal complexes containing at least the majority of the transition metal ions from the material.

13. A method as recited in claim 10 wherein the continuous digester has first and second cooking screens, the first screen vertically above the second; and wherein step (b) is practiced to introduce chelating agent adjacent the second screen, and wherein step (c) is practiced to remove metal complexes using the first screen.

14. A method as recited in claim 13 wherein the continuous digester has a third screen, below the second screen, and either a co-current or a counter-current cooking zone between the second and third screens; and wherein step (c) is practiced to also remove liquid with metal complexes from the third screen.

15. A method as recited in claim 14 wherein during all cooking zones in the continuous digester the effective alkalinity of the slurry is between 18–40 g/l expressed as NaOH.

16. A method as recited in claim 10 wherein step (b) is practiced while the pH of the slurry is greater than 10.

17. A method as recited in claim 10 wherein step (a) is practiced to heat the slurry to a temperature of at least 150° C., and step (b) at a temperature of at least 160° C.

18. A method as recited in claim 1 wherein step (b) is practiced by also adding dilution liquor, and wherein steps (a)–(c) are practiced so that the dissolved organic concentration of the slurry is less than 120 g/l throughout the continuous digester.

19. A method as recited in claim 1 wherein steps (a)–(c) are practiced so that the dissolved organic material concentration of the slurry is less than about 100 g/l during the entire time the slurry is treated with chelating agent.

20. A method as recited in claim 1 wherein the washing of step (d) is practiced in the continuous digester in a wash zone below the cooking zone; and comprising the further step of adding further chelating agent to the wash zone.

* * * * *